US007837430B2

(12) United States Patent
Cattani

(10) Patent No.: US 7,837,430 B2
(45) Date of Patent: Nov. 23, 2010

(54) ROTARY BLOWER AND ASPIRATOR HAVING A MODIFIABLE CONFORMATION

(75) Inventor: Ennio Cattani, Parma (IT)

(73) Assignee: ESAM S.P.A., Parma (IT)

( * ) Notice: Subject to any disclaimer, the term of this patent is extended or adjusted under 35 U.S.C. 154(b) by 918 days.

(21) Appl. No.: 11/725,411

(22) Filed: Mar. 19, 2007

(65) Prior Publication Data

US 2007/0224031 A1 Sep. 27, 2007

(30) Foreign Application Priority Data

Mar. 21, 2006 (EP) ..... 06425188

(51) Int. Cl.
*F04D 29/42* (2006.01)

(52) U.S. Cl. ..... 415/55.2; 416/204 R

(58) Field of Classification Search ..... 415/55.1–55.3, 415/224; 416/204 R, 213 R, 224
See application file for complete search history.

(56) References Cited

U.S. PATENT DOCUMENTS

| | | | | | |
|---|---|---|---|---|---|
| 1,973,669 | A | * | 9/1934 | Spoor | 415/55.7 |
| 3,257,955 | A | * | 6/1966 | Worst | 415/55.4 |
| 3,405,644 | A | | 10/1968 | Skinner | |
| 5,569,023 | A | * | 10/1996 | Ishida et al. | 417/326 |
| 5,599,163 | A | | 2/1997 | Heath et al. | |
| 5,779,433 | A | * | 7/1998 | Bocchi | 415/55.1 |
| 6,149,404 | A | * | 11/2000 | Dobler et al. | 417/356 |
| 2003/0077164 | A1 | | 4/2003 | Moss | |
| 2003/0118439 | A1 | | 6/2003 | Usui et al. | |

FOREIGN PATENT DOCUMENTS

| | | |
|---|---|---|
| DE | 199 58 064 A1 | 6/2000 |
| EP | 0 707 148 A1 | 4/1996 |
| EP | 1 519 050 A2 | 3/2005 |

* cited by examiner

*Primary Examiner*—Edward Look
*Assistant Examiner*—Sean J Younger
(74) *Attorney, Agent, or Firm*—Pearne & Gordon LLP

(57) ABSTRACT

The machine comprises an impeller, provided with blades connected to a central body of the impeller; the impeller is closed in a casing which defines an annular conduit, in which the blades rotate, which annular conduit exhibits an intake mouth and a delivery mouth and further exhibits a first tract which goes from the intake mouth to the delivery mouth, a free space is provided in the first tract between the rotating blades and the internal walls of the annular conduit. The conformation of the radial section of the annular conduit can be modified by application of interchangeable elements to parts of the machine which define the free space.

7 Claims, 3 Drawing Sheets

ROTARY BLOWER AND ASPIRATOR HAVING A MODIFIABLE CONFORMATION

BACKGROUND OF THE INVENTION

The invention concerns a machine, having a lateral channel and often termed air-ring blower, comprising an impeller provided with a central body to which peripheral blades are connected. The impeller is closed in a casing which defines a circumferential annular conduit, arranged on the external circumference of the casing, in which the impeller blades rotate. The annular conduit exhibits an intake mouth, through which a fluid is aspirated and enters the machine, and a delivery mouth through which the fluid is expelled from the machine itself. Both the impeller and the casing are normally made by moulding or pressing.

These machines can function either as vacuum pumps or as compressors. In the first case the induction mouth is connected to the environment where a depression is to be created and the delivery mouth is generally connected to the external atmosphere; while in the second case the induction mouth is generally connected to the external atmosphere and the delivery mouth is connected to the environment where an overpressure is to be created. In both cases the pressure at the induction mouth is lower than the pressure at the delivery mouth, so there exists a $\Delta p$ between the zone where the induction mouth is and the zone where the delivery mouth is.

The annular conduit exhibits a first tract, which, following the advancement direction of the blades in the conduit, goes from the induction mouth to the delivery mouth, and a second tract, which goes from the delivery mouth to the induction mouth. The first tract has a transversal passage section having greater dimensions than that of the second tract. More precisely, each blade fits the second tract snugly, i.e. it passes at a very tiny distance from the internal walls of the second tract; preferably this distance is the tiniest possible, compatibly with friction problems, so as to prevent fluid passage between the two mouths through the second tract. Between the internal walls of the first tract and the blades a much larger free space is left, wherein turbulent fluid movement can take place.

During operation, the dynamic action of the blades generates a fluid current in the first tract of annular conduit from aspiration to delivery. The conformation of the annular conduit, and in particular the presence of the free space between the blades and the internal walls of the first tract of annular conduit is necessary in order for the motion of the blades to effectively give rise to a current of fluid from induction to expulsion.

The impeller is keyed on a shaft, which is usually set in rotation by an electric motor and rotates internally of the casing. At the lower part of the conduit the blades of the impeller rotate in, an annular slit is afforded which enable passage of the body of the impeller internally of the casing. Between the internal part of the annular slit and the body of the impeller as small a space as possible must be left, compatibly with the problem of friction, in order to prevent passage of fluid from the channel to the internal part of the casing where the impeller shaft is located.

The functioning of these machines, which is represented by the flow rate/head diagram, as well as by the angular velocity of the impeller, is strongly influenced by the size of the machine, and in particular the size of the lateral channel and the blades. The constructors therefore offer a wide range of machines, having different dimensions, each of which operates in a determined field of flow rate/head ratings demanded by the market.

For this reason a large number of moulds has to be made available, as well as a large number of components, for realising the parts of the various machines. This inevitably leads to a considerable increase in construction costs, warehousing for spare parts and machine maintenance.

The customer also has to face the need to change machines if, over time, his requirements change.

The main aim of the present invention is to solve the above-described problems, by providing a machine of the type described which can satisfy various operational needs, while keeping the base structure and thus considerably reducing construction costs and warehousing expenses for spare parts and maintenance.

A further aim of the present invention is to realise a machine in which performance can be optimised even in various operative conditions.

An advantage of the invention is that it attains the above-cited aims in a way which is constructionally simple and economical.

A further advantage is that the invention can be easily applied to known-type machines.

A further advantage is that the invention limits the danger of the impeller's seizing.

These aims and advantages and more besides are all attained by the machine of the invention, as it is characterised in the claims that follow.

SUMMARY OF THE INVENTION

The machine comprises an impeller, provided with blades connected to a central body of the impeller; the impeller is closed in a casing which defines an annular conduit, in which the blades rotate, which annular conduit exhibits an intake mouth and a delivery mouth and further exhibits a first tract which goes from the intake mouth of the delivery mouth, a free space is provided in the first tract between the rotating blades and the internal walls of the annular conduit. The conformation of the radial section of the annular conduit can be modified by application of interchangeable elements to parts of the machine which define the free space.

BRIEF DESCRIPTION OF THE DRAWINGS

Further characteristics and advantages of the present invention will better emerge from the detailed description that follows of two preferred embodiments of the invention, illustrated by way of non-limiting examples in the figures of the drawings, in which.

DESCRIPTION OF THE PREFERRED EMBODIMENTS

Figure 1:
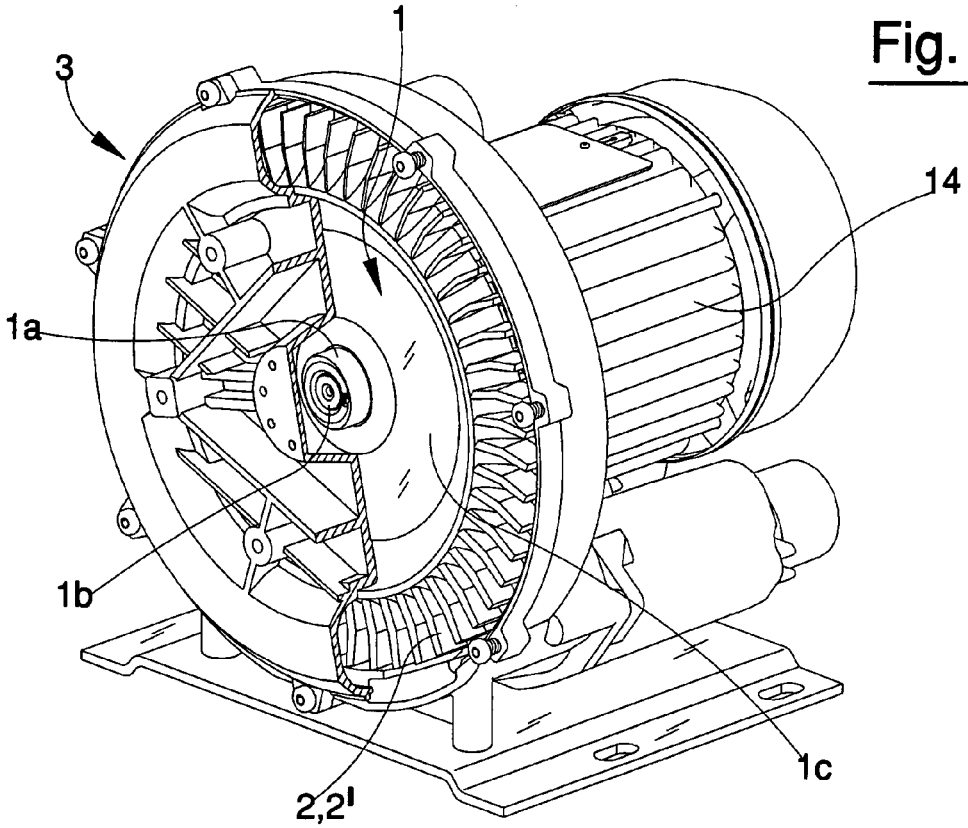
FIG. 1 is a perspective view, with some parts sectioned, of a machine of the invention.
Figure 2:
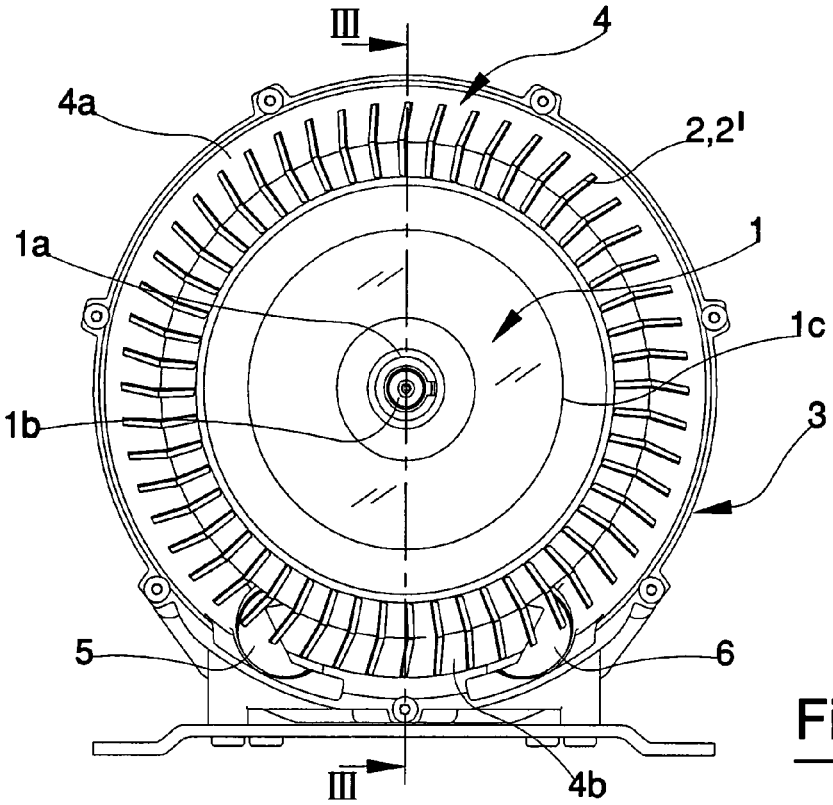
FIG. 2 is a front view of a vertical elevation of a machine of the invention from which the front cover of the casing has been removed.
Figure 5:
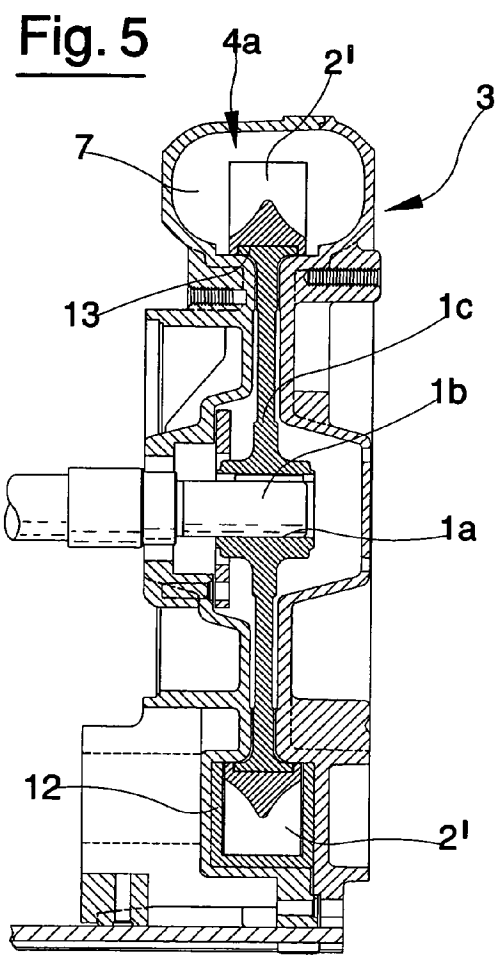
FIGS. 3, 4, 5 are sections made according to line III-III of FIG. 2, of the machine with some inter-changeable elements inserted.
Figure 4:
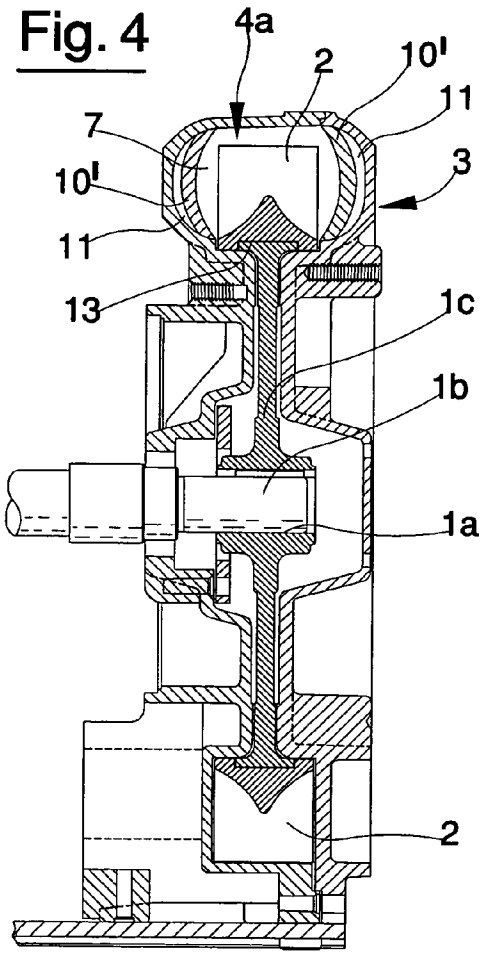
Figure 3:
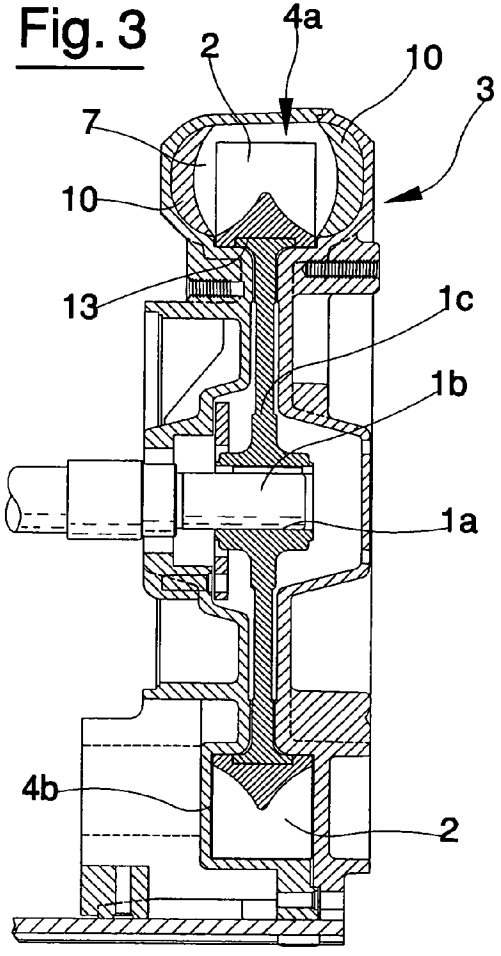
Figure 7:
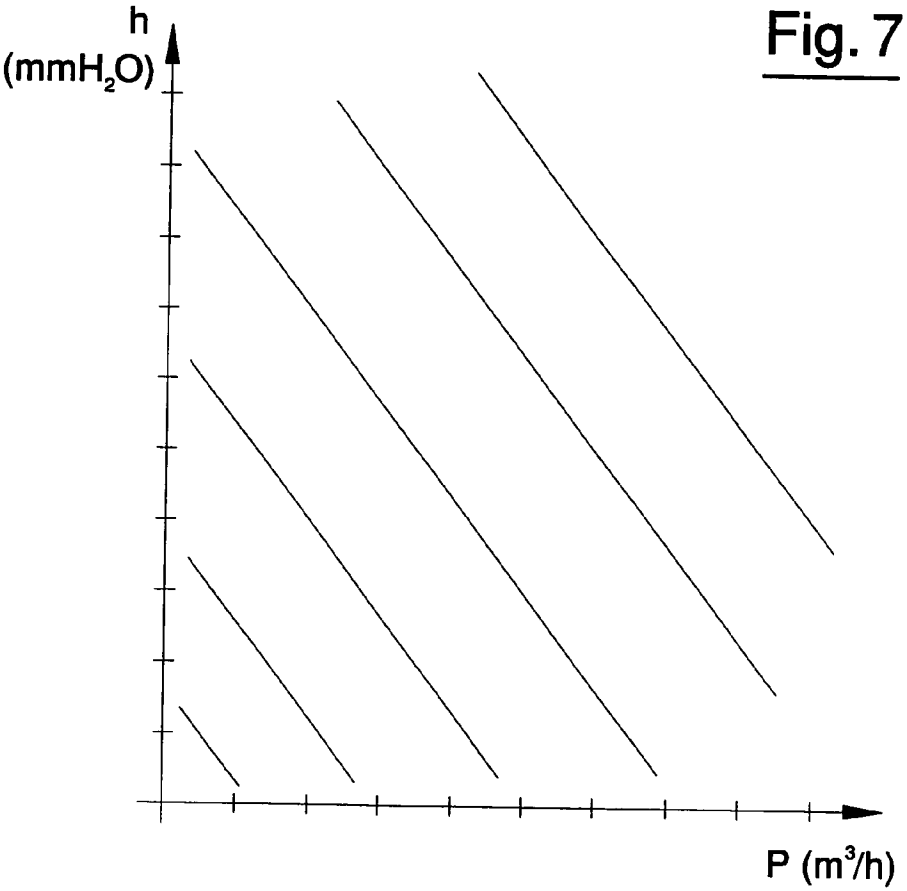
FIG. 7 is a schematic view of some flow-rate/head diagrams which can be obtained with the machine of the invention.
Figure 6:
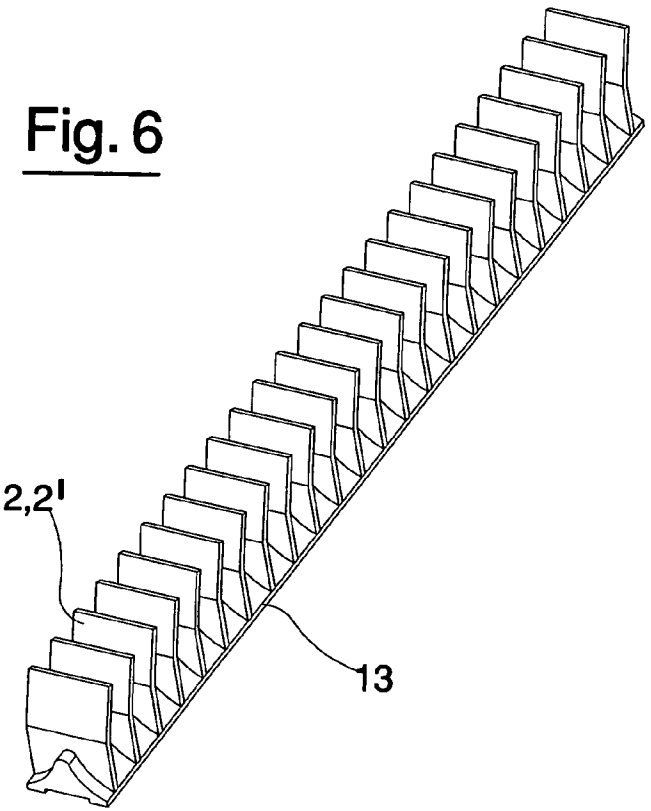
FIG. 6 is an embodiment of a series of interchangeable blades.

The machine comprises, as in known machines of this type, an impeller 1 which is provided with a hub 1*a* keyed on a shaft 1*b* which is rotated by a motor of known type, such as for example an electric motor 11; the impeller 1 exhibits a central body on which peripheral blades 2, 2' are set.

The impeller is closed in a casing 3 which defines a circumferential annular conduit 4 in which the blades 2 of the impeller rotate. The casing is normally made in two parts, one of which is connected to the electric motor and the other of which constitutes a front cover; the structure of the casing is obtained by sealedly fastening the two component parts thereof together. The annular conduit 4 exhibits two openings, respectively an intake mouth 5 for aspirating fluid from outside the machine and a delivery mouth 6 for enabling exit of the fluid from the machine; by action of the impeller blades, the fluid (normally air) is aspirated by the intake mouth 5 and, after having crossed the annular conduit 4, is expelled through the delivery mouth 6.

The annular conduit 4 exhibits a first tract 4*a* which, in the advancement direction of the blades in the conduit, goes from the intake mouth 5 to the delivery mouth 6. A free space 7 is afforded in this first tract 4*a* between the rotating blades and the internal wall of the annular conduit; internally of this first tract 4*a* the blades of the impeller rotate in such a way as to create a turbulence which enables transport of fluid from the intake mouth 5 to the delivery mouth 6.

The annular conduit 4 further exhibits a second tract 4*b* which goes from the delivery mouth 6 to the aspiration mouth 5, internally of which second tract 4*b* each blade skims the internal walls of the second tract 4*b* in order to prevent, or render extremely difficult, and fluid passage from the delivery mouth 6 to the intake mouth 5.

The machine of the invention can operate, like known-type machines and with the same operating principle, both as a vacuum pump and as a compressor; in the former case the intake mouth 5 is connected to the outside environment in which the vacuum is to be created and the delivery mouth 6 is connected to the external environment, while in the latter case the intake mouth is connected to the external environment and the delivery mouth is connected to the environment in which an overpressure is required.

The machine of the invention comprises interchangeable parts 10, 10', 2, 2'which are applied to the parts of the machine that define the free space 7, and which enable a new conformation of the radial section of the free space 7 to be defined.

In a first embodiment of the invention, the interchangeable elements can comprise a pair of inserts 10, 10' which are each connectable to one of the internal walls of the casing 3 at the first tract 4*a* of the annular channel; the inserts 10, 10' are conformed so as to define a new internal wall of the first tract 4*a*, reducing the radial section of the free space 7 with respect to the section of the radial space defined by in the internal wall of the casing 3. Naturally a plurality of pairs of inserts 10, 10' can be provided, so as to be able to modify differently, according to the pair of inserts used, the section of the free space 7. To obtain the modification without creating useless and damaging obstacles to the motion of the fluid, the inserts 10, 10' develop along all of the internal walls of the casing 3 interested by the first tract 4*a* of the annular channel 4, thus making the wall of the free space 7 continuous.

The inserts 10, 10' can in particular be conformed so that the part thereof facing the internal walls of the casing 3 reproduces the shape of the internal walls and can thus be connected contactingly with the internal walls without leaving free spaces between the internal wall of the casing 3 and the insert. The inserts 10, 10' are preferably made by moulding of a plastic material and can be connected to the casing 3 with screws or other removable connection systems of known type. In this conformation of the inserts, a very simple way is obtained to provide an especially stable and sturdy conformation of the wall defining the first tract 4*a* of the conduit 4; with this conformation however it is necessary to use different inserts each time the form of the second of the free space 7 is to be changed.

It may be advantageous to make inserts 10' connected to the internal walls of the casing 3 in such a way as to be axially displaceable with respect to the casing 3. This could be done for example by using screw connections that are length-adjustable. It may also be possible to make the inserts 10' of an elastically deformable material, and connect them to the internal walls of the casing 3 in such a way as to leave a free space 11 between the internal walls of the casing and the insert 10'. In this case means of known type are provided, for example a fluid pump, which enable introduction or extraction on command of a dilator fluid in the free space 11; in this way the inserts 10' can be displaced, and the section of the free space 7 can be changed without having to change the inserts. Though this arrangement is undoubtedly advantageous, with the radially-displaceable inserts there is a constructional complication. The interchangeable elements used can also comprise a plurality of series of blades 2, 2', each of which has blades of different dimensions with respect to the blades of the other series; each series of blades can be removably connected to the impeller 1 so that when necessary it can be removed and replaced with another series of blades.

Each series of blades advantageously includes a flexible belt 13, on which the blades of the respective series are solidly connected; the belt 13 is removable connected to the external circumference of the central body 1*c* of the impeller and can be replaced by another belt, to which a different series of blades is connected. Thus it is extremely easy to replace all the blades at the same time with a set of differently-sized blades. The connection of the belt to the external circumference of the central body of the impeller can be done by fastening screws or other known-type removable connection systems.

The belts 13 are preferably realised by pressing of a plastic material, in a single piece with the relative belts 13. While the central body 1*c* of the impeller, which is never replaced, is made of a resistant material (for example a metal or especially-resistant plastic), the belts and the blades, which do not come under especial stress, can be made of a sufficiently soft plastic material; this is so that the blades, when rotating, can deform if they drag against fixed parts, due to thermal dilation or any other cause, thus preventing any risk of the machine's seizing.

Naturally, when changing the blades, the section of the second tract 4*b* of the conduit 4, internally of which the blades approach the walls of the conduit, nearly grazing them, will have to be changed; to do this, the second tract 4*b* of the conduit 4 is defined by a plurality of series of removable walls 12, each of which can be combined to a series of blades 2, 2', which are changed every time the series of blades is changed. In this way, for each series of blades, a section of the second tract 4*b* is obtained which enables the blades of the corresponding series to graze the internal walls of the second tract 4*b*.

Using the above-described interchangeable elements, i.e. the inserts 10, 10', and the series of blades 2, 2', which can be used both singly and in combination, the same impeller body and the same motor, a series of machines are obtained which operate according to different functioning curves, something which could only be achieved using a number of known-type machines. Thanks to the fact that the interchangeable elements are much more economical to make with respect to the other parts of the machine, this versatility is obtained with a considerable saving in the machines' construction. With the kind of realisation described herein above, the whole range of machines required by the market is provided, reducing by up to two thirds the number of casings, impellers and motors of various sizes needed. Not only this, but there is also a considerable saving in terms of the number of moulds needed for the casings, which is the most expensive item for these machines; warehousing is also cheaper and simpler.

With the use of the interchangeable elements as described herein above, the machines can also be modified very economically, without having to substitute them; within certain limits, a client's changing requirements can be satisfied. A further increase in the versatility of the machine is obtained by varying the voltage supply to the electric motor 14 powering the impeller, by use of an inverter of known type. This means that when necessary the motor rotation velocity, which depends on the frequency of the power supply, can be changed. By increasing the rotation velocity of the impeller the machine head can be increased, which provides yet another variability parameter in the field of use of the machine.

What is claimed is:

1. A rotary blower and aspirator machine having a modifiable conformation, comprising: an impeller, having a hub keyed on a shaft set in rotation by a motor of known type, and further provided with blades connected to a central body of the impeller; the impeller being closed in a casing which defines a circumferential annular conduit, in which the blades rotate, which annular conduit exhibits an intake mouth for aspirating fluid from outside the machine and a delivery mouth for enabling outlet of fluid from the machine; in which the annular conduit exhibits a first tract which, in an advancement direction of the blades in the conduit, goes from the intake mouth to the delivery mouth, and a second tract which goes from the delivery mouth to the intake mouth; in which a free space is provided in the first tract between the rotating blades and the internal walls of the annular conduit, while in the second tract each blade skims the internal walls of the second tract; in which internally of the first tract the blades of the impeller rotate in such a way as to create a turbulence which enables transport of the fluid from the intake mouth to the delivery mouth;

wherein the machine includes interchangeable elements which are applicable to parts of the machine affording the free space, which when applied define a new conformation of a radial section of the free space;

wherein the interchangeable elements comprise at least a pair of inserts which are each connectable to one of the internal walls of the casing at the first tract of the annular conduit, which at least a pair of inserts is conformed in such a way as to define a new internal wall of the first tract, which reduces the radial section of the free space with respect to a radial section thereof defined by the internal wall of the casing;

wherein the at least a pair of inserts develop along an entire length of the internal walls of the casing at the first tract of the annular conduit and are connected to the internal walls of the casing in order to be displaceable in an axial direction with respect to the casing; and wherein the at least a pair of inserts are made of an elastically deformable material and are connected to the internal walls of the casing in such a way as to leave a free space between the internal walls of the casing and the at least a pair of inserts; means of known type being provided for introducing a dilating fluid into or extracting a dilating fluid from the free space.

2. The machine of claim 1, wherein the at least a pair of inserts develop along an entire length of the internal walls of the casing at the first tract of the annular conduit, reproducing a conformation of the internal walls without leaving free spaces between the internal wall of the casing and the at least a pair of inserts.

3. The machine of claim 2, wherein the at least a pair of inserts are made by moulding of a plastic material.

4. The machine of claim 1, wherein: the interchangeable elements comprise a plurality of series of blades, each series of the plurality of series having blades of a different size from the blades of the other series of the plurality; the blades of the plurality of series being removably connectable to the impeller; a section of the second tract of the conduit being defined by a plurality of series of removable walls; each of the plurality of series of removable walls being able to combine with a series of the plurality of series of blades in order to define, for each series of blades of the plurality, a section of the second tract which enables the blades of the series of blades to skim the internal walls of the second tract.

5. The machine of claim 4, wherein each series of blades comprises a flexible belt, on which blades of each series of blades are solidly constrained; the flexible belt being removably connected to the external circumference of the central body of the impeller.

6. The machine of claim 5, wherein the flexible belt is made by moulding a plastic material in a single piece with the blade.

7. The machine of claim 1, wherein the motor powering the shaft in rotation is an electric motor supplied by an inverter of known type.

* * * * *